United States Patent [19]

Morris

[11] Patent Number: 4,704,093

[45] Date of Patent: Nov. 3, 1987

[54] HIGH PRESSURE SODIUM VAPOR LAMP WITH IMPROVED CERAMIC ARC TUBE

[75] Inventor: Vincent P. Morris, Willoughby, Ohio

[73] Assignee: General Electric Company, Schenectady, N.Y.

[21] Appl. No.: 851,191

[22] Filed: Apr. 14, 1986

Related U.S. Application Data

[62] Division of Ser. No. 621,974, Jun. 18, 1984, abandoned.

[51] Int. Cl.[4] ..... H01J 9/24; H01J 61/22

[52] U.S. Cl. ..... 445/26; 445/44

[58] Field of Search ..... 445/26, 23, 28, 29, 445/32, 44

[56] References Cited

U.S. PATENT DOCUMENTS 3,564,328 2/1971 Bagley ..... 313/220
3,986,236 10/1976 Barakitis ..... 445/26
4,034,252 7/1977 McVey ..... 445/44
4,065,691 12/1977 McVey ..... 313/174
4,545,799 10/1985 Rhodes ..... 65/59.21

*Primary Examiner*—K. Rowan
*Attorney, Agent, or Firm*—Philip L. Schlamp; J. F. McDevitt; Fred Jacob

[57] ABSTRACT

An improved high pressure sodium lamp is described utilizing a polycrystalline alumina arc tube that is hermetically sealed, at least at one end, with a polycrystalline alumina end closure. Said end closure novel member is shaped as a flat disc having the contour and size permitting partial insertion into the internal opening of said arc tube, along with having a larger size projection located adjacent one major surface of said disc externally of said arc tube and with said disc being hermetically sealed directly to said arc tube. In a preferred embodiment, said end enclosure member further includes a central aperture through which extends one of the thermionic electrodes contained within said arc tube.

10 Claims, 3 Drawing Figures

HIGH PRESSURE SODIUM VAPOR LAMP WITH IMPROVED CERAMIC ARC TUBE

This is a division of application Ser. No. 621,974, filed Jun. 18, 1984, now abandoned.

BACKGROUND OF THE INVENTION

High pressure sodium vapor lamps utilizing a polycrystalline alumina arc tube hermetically sealed at each end with ceramic end closures of various types are already known. For example, in U.S. Pat. No. 4,442,378, assigned to the assignee of the present invention, there is described an arc tube construction wherein ceramic plugs are inserted into each end of the arc tube and hermetically sealed thereto with a sealing glass frit by conventional means. Each of said ceramic plugs further include central apertures or openings through which extend lead-in conductors that are connected to the thermionic electrodes contained wthin said arc tube. The conventional thermionic electrodes comprise refractory metal coils wound around a tungsten shank and with one of said electrodes further including a tubular metal in-lead conductor extending externally from said arc tube and containing a reservoir of sodium-mercury amalgam in excess of the quantity vaporized during lamp operation. Inert gas filling is also contained within said arc tube to facilitate lamp starting and the conventional lamp construction further includes an outer light-transmitting envelope surrounding said arc tube having a stem press seal at one end through which extends a pair of in-leads electrically connected to said thermionic electrodes.

A different type of ceramic end closure has also been used to hermetically seal one or both ends of a polycrystalline alumina arc tube in said lamps wherein a flat polycrystalline alumina disc with a contour and size enabling total insertion into the internal opening of said arc tube was directly sintered together without sealing glass frit. In said prior art arc tube eonstruction, the plug and tube members were presintered separately in air and with said plug members thereafter being partially sintered at higher elevated temperatures sufficiently to cause shrinkage of the ceramic material. The partially sintered end plugs were then assembled into one or both ends of the presintered arc tubes for sintering together, generally in a hydrogen atmosphere, whereupon shrinkage of the arc tube around the disc contour produced the desired hermetic sealing therebetween. The manner in which said final sintering operation was carried out consisted of simply inserting the plug or plug members into the tube ends and sintering the assembly while oriented in a horizontal direction to prevent movement of the inserted plug members inside the tube before maling together had occurred. More particularly, the conventional end plugs were inserted by hand into a longer length of the polycrystalline alumina tubing at spaced apart locations corresponding to individual arc tube lengths and with said sealed arc tubes being cut to length after said final sintering step. Uneven shrinkage often resulted during said conventional final sintering step, however, either causing the arc tube to bulge or misalignment between the disc and the arc tube to occur so that the sintered assembly could not be used in either case.

Accordingly, it would be desirable to provide an improved method and means to produce this type arc tube construction with greater reliability and to do so in a manner which does not require significant modification of the existing manufacturing process. It would be further desirable to provide said improved ceramic enclosure eliminating the customary step of hand-cutting the sealed arc tube to length before use in the final lamp manufacture. Additionally, such elimination of cutting the sealed arc tubes to length after the final sintering step further reduces manufacturing costs attributable to cleaning the cut assemblies.

SUMMARY OF THE INVENTION

An improved method to hermetically seal at least one end of a polycrystalline alumina arc tube with a polycrystalline alumina end closure has now been discovered whereby the arc tube and one or more end closures, also of polycrystalline alumina material, and having a particular geometrical configuration, can be sintered together to provide a direct hermetic seal therebetween without experiencing deformation of the assembled parts. More particularly, the present end closure configuration is in the form of a flat disc having the contour and size of the internal opening in said arc tube and which further includes a larger size projection located at one major surface of the disc enabling said disc to be more accurately centered in the arc tube opening when the parts are sintered together. It now becomes possible to partially insert said novel end closure member into the arc tube for said final sintering operation and to carry out the sintering action while said assembly is positioned in an upright position. Such suspension of the novel end closure member in the arc tube by gravitational forces maintains the disc in the center of the arc tube as the arc tube shrinks evenly around the circumference of the disc. In like manner, said novel end closure member can be partially inserted into the bottom end of said arc tube opening for hermetic sealing directly thereto during the same above described sintering step. Since the arc tube is of the correct length, once the final sintering action takes place, it is no longer necessary to cut said closed arc tube into the proper length for subsequent use in the lamp manufacture. Further surprisingly, the sintering of said assembly in a vertical manner also substantially eliminates a bowed condition frequently experienced when sintering was carried out with said assembly being oriented in a horizontal position.

Accordingly, said improved method to hermetically seal at least one end of a polycrystalline alumina arc tube with the polycrystalline alumina end closure comprises:

(a) forming said end closure as a flat disc having the contour and size of the internal opening in said arc tube after partial sintering and which further includes a larger size projection located adjacent one major surface of said disc,
(b) partially sintering said disc sufficiently to shrink in size and permit assembly with the arc tube,
(c) presintering the arc tube sufficiently to increase mechanical strength,
(d) suspending the partially sintered disc in one end of the partially presintered arc tube, and
(e) fully sintering the assembled arc tube and disc together sufficiently to produce a direct hermetic seal therebetween.

In its preferred embodiments, the novel end closure member comprises a flat circular disc with a projecting circular rim of larger diameter located at one end of said member and which is partially inserted into the entrance end of a cylindrically shaped hollow arc tube so that the disc rim extends externally after being sealed together. As previously indicated, the separate presintering of the arc tube and disc parts can be carried out in an oxygen containing atmosphere. The partial sintering of the disc parts and the final sintering of the assembled parts takes place under non-oxydizing conditions, however, which can include hydrogen or vacuum.

A representative high pressure sodium vapor lamp, according to the present invention, utilizes a tubular light-transmitting polycrystalline alumina arc tube which can contain a reservoir of sodium-mercury amalgam in excess of the quantity vaporized during lamp operation along with thermionic electrodes being directly sealed into its ends with polycrystalline alumina end closures. Said improvement comprises having at least one of said end closures in the form of a flat disc having the contour and size permitting partial insertion into the internal opening of said arc tube and with a larger size projection being located adjacent one major surface of said disc such that said end closure can be vertically suspended within said arc tube when sintered directly together. In its preferred embodiments, said disc-shaped end closure member further includes a central aperture or opening through which extends one of the thermionic electrodes contained within said arc tube. The configuration of said thermionic electrodes is described in the aforementioned U.S. Pat. No. 4,442,378 wherein refractory metal coils are wound around a tungsten shank. In a preferred embodiment, said improved high pressure sodium vapor lamp there by comprises:

(a) a light-transmitting polycrystalline alumina arc tube having a thermionic electrode sealed into each end with polycrystalline alumina end closures, a quantity of sodium-mercury amalgam, and an inert gas filling to facilitate lamp starting, (b) an evacuated outer light-transmitting vitreous envelope surrounding said arc tube having a stem press seal at one end through which extends a pair of inleads electrically connected to said thermionic electrodes, and (c) wherein the improvement comprises having at least one of said end closures in the form of a flat disc having the contour and size permitting partial insertion into the internal opening of said arc tube along with having a larger size projection located adjacent one major surface of said disc externally of said arc tube and with said disc being hermetically sealed directly to said arc tube.

In other preferred embodiments, said arc tube can further include a reservoir of sodium-mercury amalgam in excess of the quantity vaporized during lamp operation. Said amalgam reservoir can be provided in the customary manner wherein one of said thermionic electrodes includes a tubular metal inlead conductor hermetically sealed to said arc tube and extending externally therefrom to provide said amalgam reservoir at its external end and said tubular metal inlead being joined at its opposite end to an electrode located within said arc tube mounted on a metal shank.

DETAILED DESCRIPTION OF THE PREFERRED EMBODIMENTS

Figure 1:
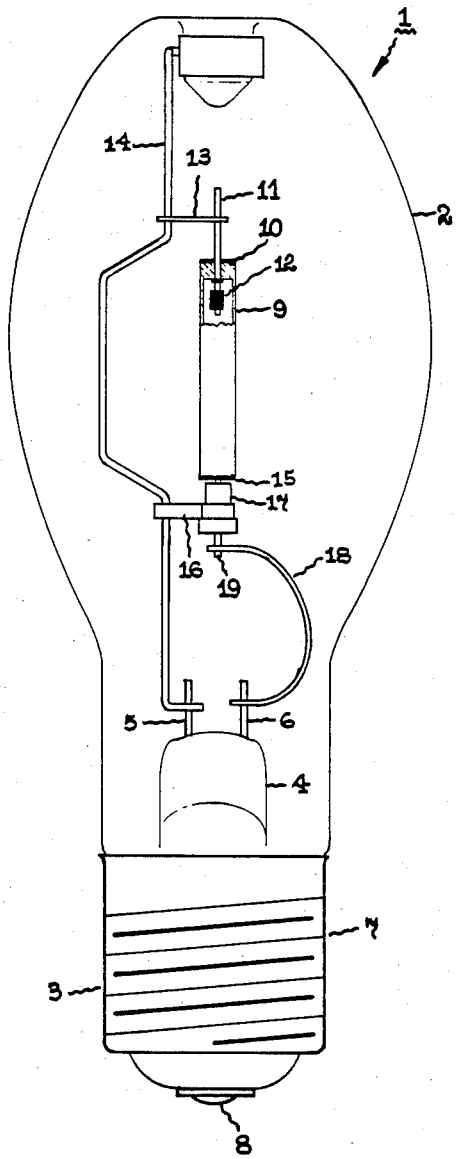
FIG. 1 shows a high pressure sodium vapor lamp embodying the presently improved arc tube assembly.

Referring to FIG. 1 a representative 50W size mogul base lamp 1 is illustrated which comprises a vitreous outer envelope 2 having a standard mogul screw base, 3 attached to one end by a re-entrant stem press seal 4 through which extends a pair of relatively heavy lead-in conductors 5 and 6, whose outer ends are connected to the screw shell 7 and the eyelet 8 of the base. The inner envelope or arc tube 9, centrally located within said outer envelope, comprises a closed length of light-transmitting polycrystalline alumina ceramic tubing, which is translucent. The upper end of said arc tube is hermetically sealed by an improved polycrystalline alumina end closure member 10 according to the present invention, through which extends a niobium in-lead wire 11 also hermetically sealed to said end closure member. Said in lead supports an upper thermionic electrode 12 contained within the arc tube which may be generally similar to the lower thermionic electrode and with both electrodes having the same general construction described in the aforementioned U.S. Pat. No. 4,442,378. The external portion of in-lead 11 connects to a transverse support wire 13 attached to a side rod member 14. Lower end closure member 15 for said arc tube has a central aperture through which extends said bottom thermionic electrode (not shown). The hermetically sealed arc tube is physically supported in the outer envelope by a metal ribbon 16 which is welded to side rod 13, but electrically isolated from arc to by an insulating bushing 17. A second lead-in conductor 18 is electrically connected to niobium in-lead wire 19 for the lower thermionic electrodes assembly. Both of said thermionic electrodes in the illustrated lamp embodiment comprises refractory metal coils wound around a tungsten shank.

Figure 3:
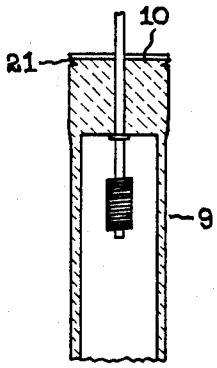
FIG. 3 is another enlarged detailed view depicting said assembly after being fully sintered together.
Figure 2:
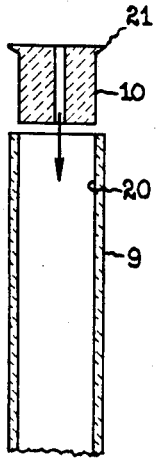
FIG. 2 is an enlarged detailed view depicting one end of the present arc tube assembly before inserting the end closure member into the arc tube opening.

The present invention resides in the arc tube construction itself which is depicted before assembly in FIG. 2. Specifically, said arc tube 9 comprises a hollow cylindrically shaped length of polycrystalline alumina tubing into which is partially inserted a partially sintered polycrystalline alumina disc closure 10 for direct hermetic sealing together in the manner previously indicated. When inserted into the internal opening 20 of said arc tube member, a circular projection 21 located at the top major surface of said disc member 10 provides means to physically suspend said member in the arc tube when the direct hermetic sealing action takes place. More particularly, the assembled arc tube and disc members are oriented in a generally vertical direction during the final sintering step so that the disc remains centered in the hollow opening during shrinkage of the arc tube which takes place during said sintering action. An illustrative example is herein provided for said improved method to better enable practice of the present invention. Accordingly, the unassembled arc tube and disc members are first presintered in an oxygen containing atmosphere such as air, at approximately 1000°–1100° C. for about 4 hours. The presintered disc member is then partially sintered in a hydrogen atmosphere at approximately 1300°–1400° C. for about 1 hour which shrinks said member sufficiently to fit within the internal opening of the arc tube. The partially centered disc member is then suspended in the upper end of said presintered arc tube and the assembly fully sintered together, in a reducing atmosphere such as hydrogen, while maintained in said upright position. This sintering action is carried out at 1900° C. for approximately 4 hours which produces relatively even shrinkage of said arc tube member around the circumference of the circular disc and effectively removes any boundary being visible at the joint intersection as depicted in FIG. 3.

It will be apparent from the foregoing description that various structural modifications can be made in the specifically described lamp construction without departing from the spirit and scope of the present invention. For example, other thermionic electrodes described more fully in the aforementioned U.S. Pat. No. 4,442,378 and which include reservoir means to provide sodium-mercury amalgam can be substituted in the above specifically disclosed lamp embodiment. Additionally, a diffuse coating can be applied on the inner surface of the outer vitreous envelope, if desired, to reduce glare emitting from the lamp that otherwise may be encountered. Accordingly, it is intended to limit the scope of the present invention only by the scope of the following claims.

I claim:

1. An improved method to hermetically seal at least one end of a polycrystaline alumina arc tube with a polycrystalline alumina end closure in the absence of sealing compound or frit which comprises:

(a) forming said end closure as a flat disc having the contour and size of the internal opening in said arc tube after partial sintering and which further includes a larger size projection located adjacent one major surface of said disc;

(b) presintering both said disc and said arc tube in an unassembled condition sufficiently to increase the mechanical strength thereof;

(c) partially sintering only said disc at a temperature and for a time sufficient for said disc to shrink in size and permit assembly of said disc with said arc tube;

(d) suspending the partially sintered disc in one end of the presintered arc tube, and (e) fully sintering the assembled arc tube and disc together sufficiently to produce a direct hermetic seal therebetween without producing deformation of the arc tube, wherein said sintering occurs with the assembled arc tube and disc oriented in a substantially vertical position with respect to the longitudinal axis of said assembly.

2. A method as in claim 1 wherein said arc tube has a cylindrical shape.

3. A method as in claim 2 wherein said disc has a circular shape with a projecting circular rim located adjacent one end of said cylindrical member.

4. An improved method to hermetically seal at least one end of a polyrystalline alumina arc tube with a polycrystalline alumina end closure in the absence of sealing compound or frit which comprises:

(a) forming said end closure as a flat disc having the contour and size of the internal opening in said arc tube after partial sintering and which further includes a large size projection located adjacent one major surface of said disc;

(b) presintering the unassembled arc tube and disc in an oxygen containing atmosphere at approximately 1000°-1100° C.

(c) partially sintering only said disc in a non-oxidizing atmosphere at approximately 1300°-1400° C., (d) suspending the partially sintered disc in one end of the presintered arc tube, and (e) fully sintering the assembled arc tube and disc together in a non-oxidizing atmosphere while oriented in a vertical direction without producing deformation of the arc tube.

5. A method as in claim 4 wherein said arc tube has a cylindrical shape.

6. A method as in claim 5 wherrein said disc has a circular shape with a projecting circular rim located adjacent one end of said cylindrical member.

7. A method as in claim 5 wherein the assembled arc tube and disc are oriented in a vertical direction when fully sintered together.

8. An improved method to hermetically seal at least one end of a polycrystalline alummina arc tube with a polycrystalline alumina end closure in the absence of sealing compound or frit which comprises:

(a) forming said end closure as a flat disc having the contour and size of the internal opening in said arc tube after partial sintering and which further includes a large size projection located adjacent one major surface of said disc;

(b) presintering the unassembled arc tube and disc in an oxygen containing atmosphere at approximately 1000°-1100° C.;

(c) partially sintering only said disc in hydrogen at approximately 1300°-1400° C. until said disc has shrunk sufficiently in size to permit assembly with the presintered arc tube;

(d) suspending the partially sintered disc in one end of the presintered arc tube, and (e) fully sintering the asembled arc tube and disc together in a reducing atmosphere while oriented in a vertical direction without producing deformation of the arc tube.

9. A method in claim 8 wherein the oxygen containing atmosphere is air.

10. A method as in claim 8 wherein the reducing atmosphere is hydrogen.

* * * * *